US007059934B2

(12) United States Patent
Whitehead

(10) Patent No.: US 7,059,934 B2
(45) Date of Patent: Jun. 13, 2006

(54) TOY

(75) Inventor: Brian Whitehead, London (GB)

(73) Assignee: Origin Products, Ltd., London (GB)

( * ) Notice: Subject to any disclaimer, the term of this patent is extended or adjusted under 35 U.S.C. 154(b) by 183 days.

(21) Appl. No.: 10/912,685

(22) Filed: Aug. 5, 2004

(65) Prior Publication Data

US 2005/0032458 A1 Feb. 10, 2005

(30) Foreign Application Priority Data

Aug. 7, 2003 (GB) ..... 0318478.5

(51) Int. Cl.
*A63H 3/52* (2006.01)

(52) U.S. Cl. ..... 446/477; 446/484

(58) Field of Classification Search ..... 446/476–478, 446/487, 484, 485, 129, 91, 82; 273/237–238
See application file for complete search history.

(56) References Cited

U.S. PATENT DOCUMENTS 4,233,778 A * 11/1980 Lemelson ..... 446/92
4,883,440 A 11/1989 Bolli
5,154,615 A * 10/1992 Joubert ..... 446/91
5,197,741 A * 3/1993 Wu ..... 273/237
5,435,769 A * 7/1995 Bertrand ..... 446/476
5,742,486 A * 4/1998 Yangkuai ..... 446/91
5,782,186 A 7/1998 McTaggart
6,065,253 A * 5/2000 Ojeda ..... 446/478
6,168,494 B1 * 1/2001 Engel et al. ..... 446/477
6,190,174 B1 * 2/2001 Lam ..... 434/169
6,193,581 B1 2/2001 Wiggs et al.
6,227,931 B1 * 5/2001 Shackelford ..... 446/477
6,443,796 B1 * 9/2002 Shackelford ..... 446/484
6,565,413 B1 * 5/2003 Brownrigg ..... 446/476

FOREIGN PATENT DOCUMENTS

EP 0 914 853 A2 5/1999
JP 2000037568 A * 2/2000
JP 2002263377 A * 9/2002

* cited by examiner

*Primary Examiner*—John A. Ricci
(74) *Attorney, Agent, or Firm*—Woodard, Emhardt, Moriarty McNett & Henry LLP

(57) ABSTRACT

The invention relates to the provision of a play area of a toy, typically a model, said play area provided for the selective placement of toy articles thereon, at least one of which has a function which is activated by the provision of electrical power to the article. The play area is provided with electrically conductive material on at least a portion thereof which is connected to a power supply such that when the article, which has electrical contacts thereon, is placed on the play area portion, power is supplied to the article and the function activated.

13 Claims, 7 Drawing Sheets

TOY

The invention to which this application relates is to a toy of the type which includes at least one playbase and/or play surfaces with which one, or a series of articles, can be positioned and selectively utilised by a child to play.

Typically, when providing a playbase or play surface with a series of articles, the playbase and/or surface and the articles have a common theme. For example, if the playbase or surface depict the room or rooms of a house, the articles depict particular implements which may be used in the various rooms of the house such that the child can selectively place the articles onto the playbase in specific locations as they wish, when playing with the toy.

Furthermore, it is known to provide the articles with attachment means to allow the articles to be selectively attached onto the playbase or surface, or yet further, to provide the articles and playbase or surface with mutually attracting material such as, for example, a metallic surface with magnetic material provided on the article. This mutual attraction allows the articles to be positioned and retained in position as required.

A problem with these known systems is that, while every effort can be made to allow the articles and playbase and/or surface to be as lifelike as possible, there is still a very limited ability for the articles to interact with the playbase or surface and this detracts from the realism of the toy. Furthermore there is often little or no interaction between the article and playbase and/or surface without the obvious intervention of the child. Indeed the only known way is to provide the vehicle with a battery power source but this renders the article bulky, the batteries can soon run out and there is required to be a switch on and off mechanism.

The aim of the present invention is to provide an additional interactive function between the articles and playbase or surface in such a way that allows the interaction to occur even when the articles arc positioned at a number of different locations on the playbase or surface. A further aim is to allow the interaction to occur without any obvious intervention from the child playing with the toy.

In a first aspect of the invention there is provided a toy, said toy including a playbase and/or play surface and, at least one article, said article provided for selective positioning on the playbase and/or surfaces and provided with location means to allow the said article to be retained in a selected position, said at least one article having a function which can be selectively changed between an inactive condition and an active condition and wherein at least one portion of the playbase or play surface includes an electrically conductive material portion connected to a power supply and said article includes electrical contacts such that the article can be placed on said electrical track to complete an electrical circuit to supply power to the article and change said functions to an active condition.

In one embodiment, the article includes first and second electrical contacts. Typically the contacts arc located at the base of said article. In one embodiment the contacts also act as the retaining means for the article on said surface.

In one preferred embodiment, the playbase or surfaces include or are formed by, a magnetically attractive material and the contact means on the article are magnetic. This form of location means, in addition to securely locating the article, also provides a clamping effect between the electrical contacts of the article and the electrically conductive material on the playbase or surface thereby ensuring secure and reliable electrical contact.

In one embodiment the electrically conductive material is applied in the form of a track or tracks, typically to the underside of the playbase or surface.

In one embodiment, the electrical circuit track or tracks are applied to the playbase or surface in a substantially planar form such as, for example, by the application of a suitable conductive ink or inks, The track is typically applied in a configuration so as to ensure that the adjacent portions of the track can be spanned by the base of the article such that the respective electrical contacts each make contact with the track. Thus the spacing between adjacent tracks matches the spacing of the electrical contacts on the article. In one embodiment the electrical circuit track is formed by the application of conductive ink and, by the selection of a suitable colour or colours to match the colour or colours of the base, the track can be rendered "invisible" to the child playing with the toy.

By suitably spacing the contact means and the application of the track of the electrical circuit, so certainty can be provided in that, when the child places the article within the portion which includes the electrically conductive material, electrical contact and completion of the circuit will be achieved quickly and hence electrical power is supplied to the article. This in turn allows the function within the article to change to the active condition.

It is envisaged that the electrical function within the article can be of many different forms to suit the normal operating characteristic of the real-life item depicted by the article.

For example, if the article depicts a radio, when electrical contact is made, the function within the article is a sound generating means which generates a sound such as for example, a song to imitate the radio being switched on.

In another embodiment, if the article function is a movement means, said movement means commences to move once the electrical contact is made. For example, the article can depict a ceiling fan which, when the article is placed onto a portion of the surface depicting the ceiling of a toy house and which includes the electronically conductive material, commences to rotate.

In a further aspect of the invention there is provided a toy model, said model depicting a play environment in which one or a series of articles can be selectively positioned and retained in said position by engagement means, and when said article has a function which is activated upon the supply of electrical power thereto via electrical contacts mounted on the article and said model includes at least one surface on or adjacent to which is provided an electrically conductive track over a defined area, said track connected to a power supply such that positioning of said article in said defined area causes power to be supplied to activate the function.

In one embodiment the surface has indication means thereon, to indicate the area where activation of the article function, can be achieved.

In one embodiment the surface or surfaces are selectively positionable with respect to the toy model.

Specific embodiments of the invention are now described with reference to the accompanying drawings, wherein:

FIG. 1*a* illustrates an elevation of one embodiment of the invention;

FIG. 1*b* illustrates part of the playbase of FIG. 1*a* in more detail;

FIG. 1*c* illustrates in detail one embodiment of an electrical circuit track of the type shown in FIG. 1*a;*

Figure 1A:
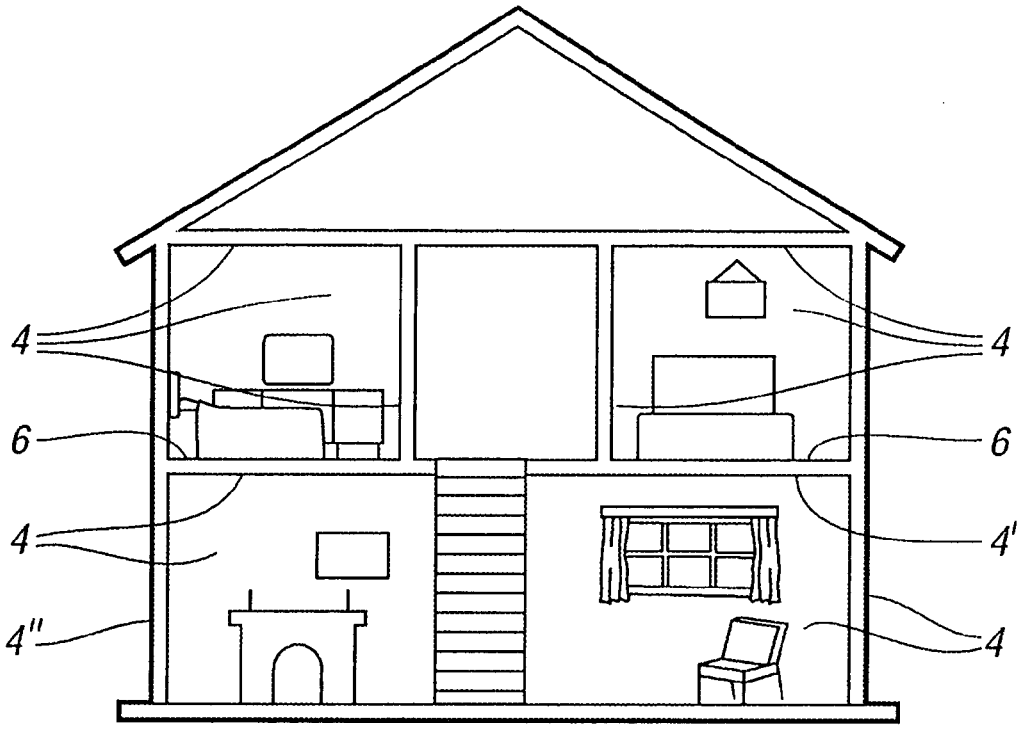

Referring firstly to FIGS. 1*a* and *b*, there is illustrated a playbase 2 and play surfaces 4 in the form of five rooms of a house in a model form. The front of the house has been removed from the drawings for the purpose of illustration. In this case, the playbase is the ground floor and the play surface any of the walls or ceilings with the first floor 6 also a play surface. The play base and play surfaces and can be coloured and/or otherwise have items depicted thereon to mimic the scenes a child would expect to find in a normal house. Typically the playbase and surfaces include or are made from magnetic material and/or magnetically attractive material so as to allow magnetic attraction with the articles to be placed thereon.

In this case, the floors 2, 6 of the rooms, the ceiling 4' of one of the rooms and the wall 4" of another of the rooms, are provided with an electrical circuit track with power supply connections.

Figure 1B:
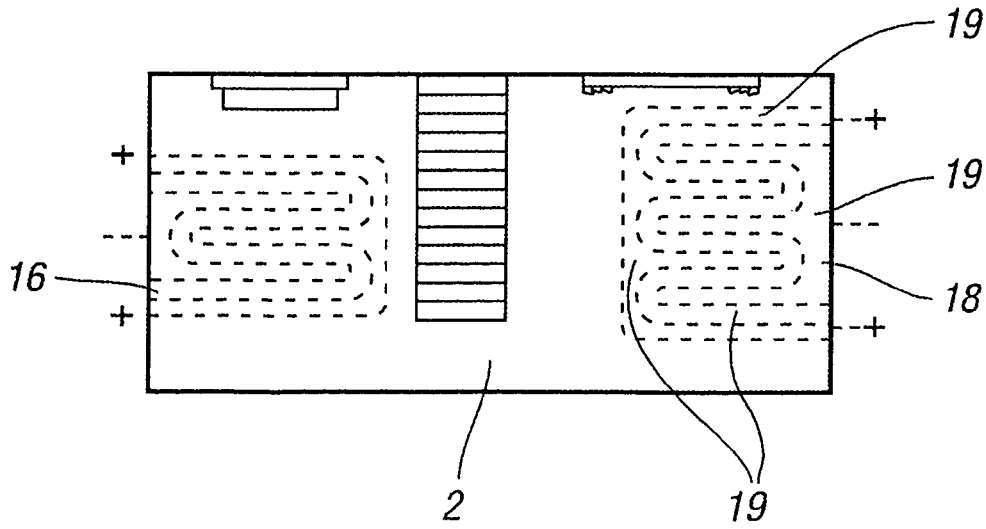

For the purpose of illustration the floor 2 is shown with two electrically conductive areas 16, 18 in the form of tracks with a periphery area 19 indicated in broken lines in FIG. 1*b*. The conductive material can be applied over an area as required but typically will not be viewable to the child playing with the toy. However, on the locations on the surface of the playbase where the track is provided, some indication of the size of the area where electrical connection can be made may be provided.

Figure 1C:
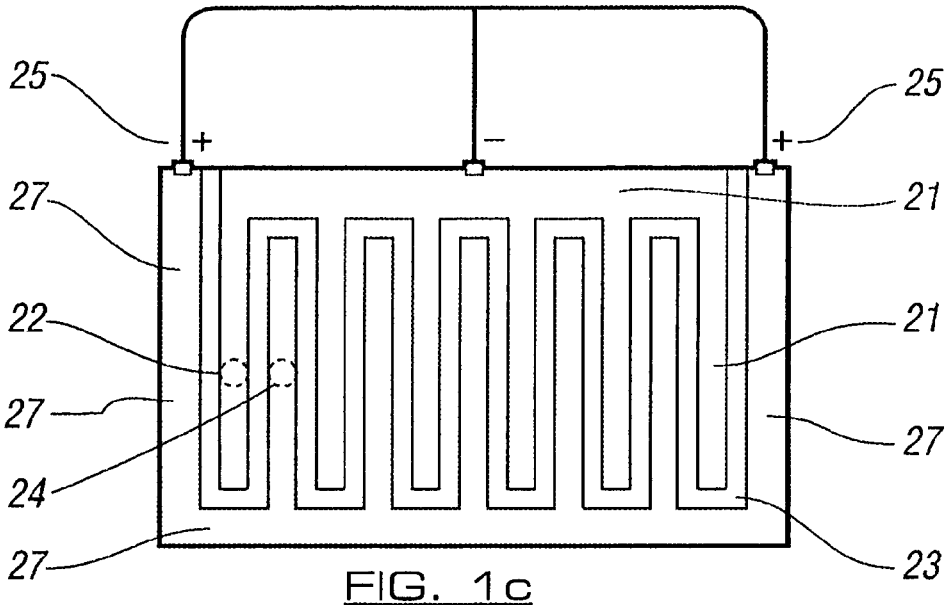

FIG. 1*c* illustrates one of the electrical circuit tracks in more detail. Each of the electrical circuits ate connected to a power supply such as batteries provided within the toy. Preferably each circuit is provided in a planar form and can be provided, for example, as a pad in which the electrical circuit track is provided or, preferably, the track is applied by the application of conductive ink to the playbase or play surface as required with the said conductive ink defining the circuit track. The track 21 is interspersed with a non conductive boundary 23 which is typically greater in width than the largest size of the contact surface on the article so as to prevent shorting between adjacent parts of the track 21.

Typically the positive electrical supply 25 is connected to both ends of the track 21 to minimise any losses from the resistance of the ink used to form the track. Preferably the peripheral track 27 is wider than the remainder of the track 21 so as to reduce the effects of resistance. Thus when an article, with two contacts 22, 24 thereon is placed on the surface with the electrical contact track 21 thereon, as illustrated in FIG. 1*c* with the contacts shown in broken lines, so the electrical connection is made and the power passes through the article to activate the function.

Figure 2:
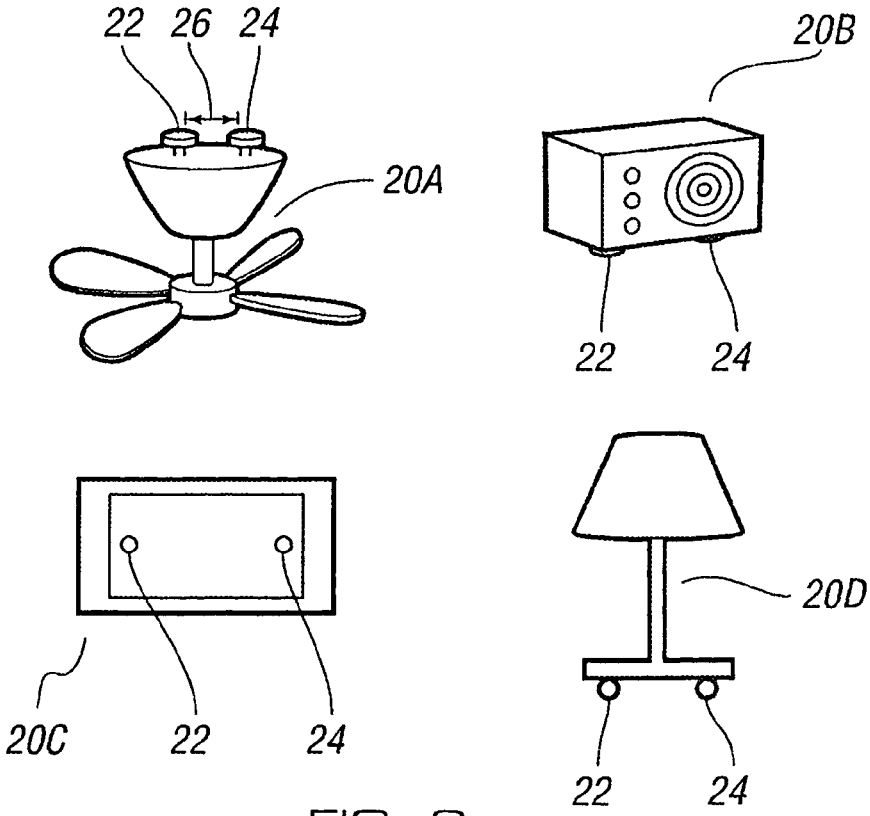
FIG. 2 illustrates a range of articles which arc in accordance with the invention.

FIG. 2 illustrates a range of articles 20A, 20B, 20C, 20D in accordance with the invention, said articles, in this case, including an article defining a ceiling fan 20A, an article depicting a radio 20B, television 20C and an article depicting a table lamp 20C In each case the base of the article is provided with two electrical contacts 22, 24 as shown. In this embodiment, the electrical Contacts arc also magnetic but the magnetic material or other location means can be provided separately on the base. The two contact means are spaced apart a distance 26 as shown with the spacing apart of the contact means matching the spacing between adjacent tracks of the electrical circuit on the playbase or play surface.

Figure 3:
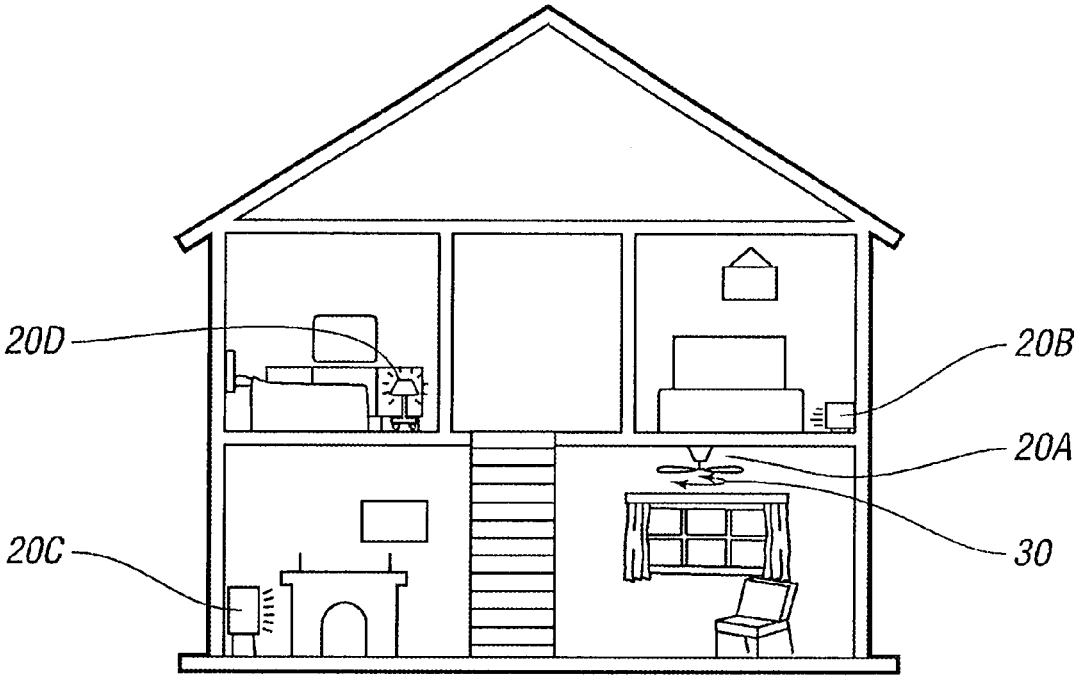
FIG. 3 illustrates some of the articles of FIG. 2 in position on the playbase of FIG. 1.
Figure 4A:
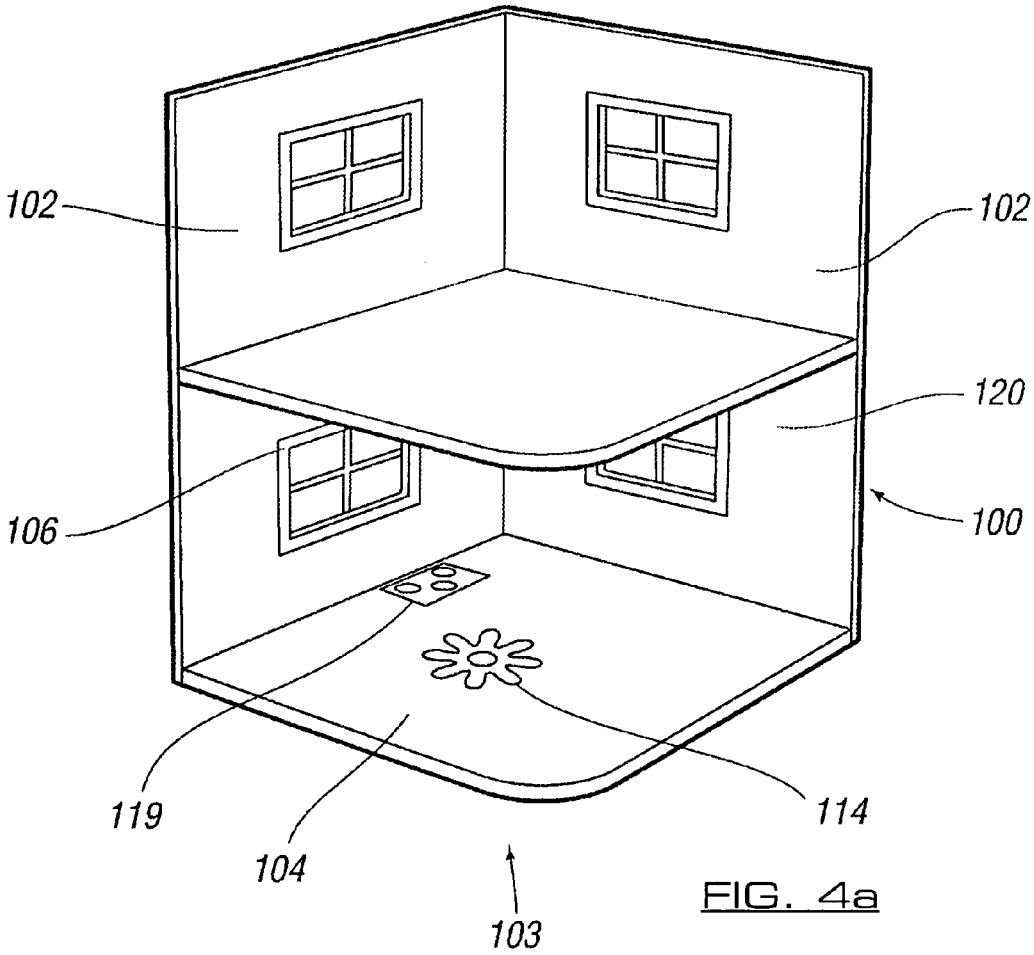
FIGS. 4*a–g* illustrate a further embodiment of the invention.
Figure 4B:
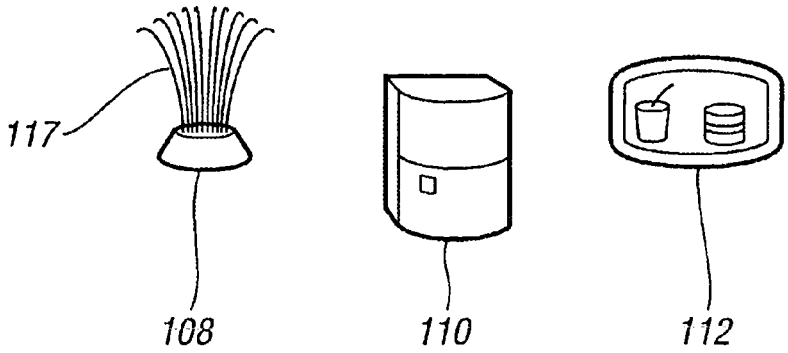
Figure 4C:
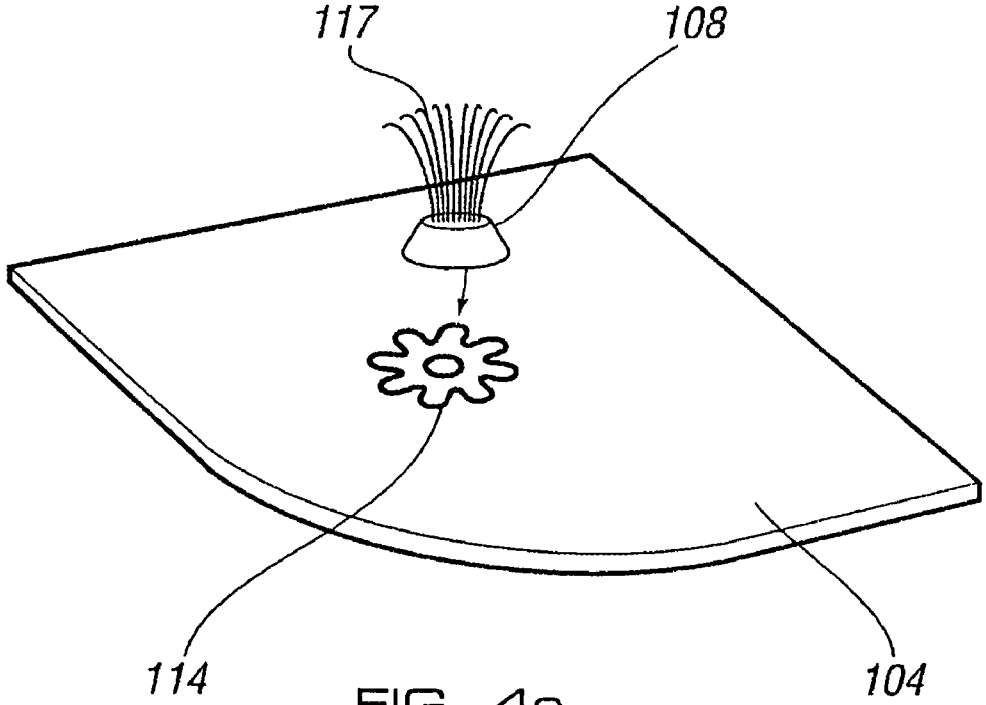
Figure 4D:
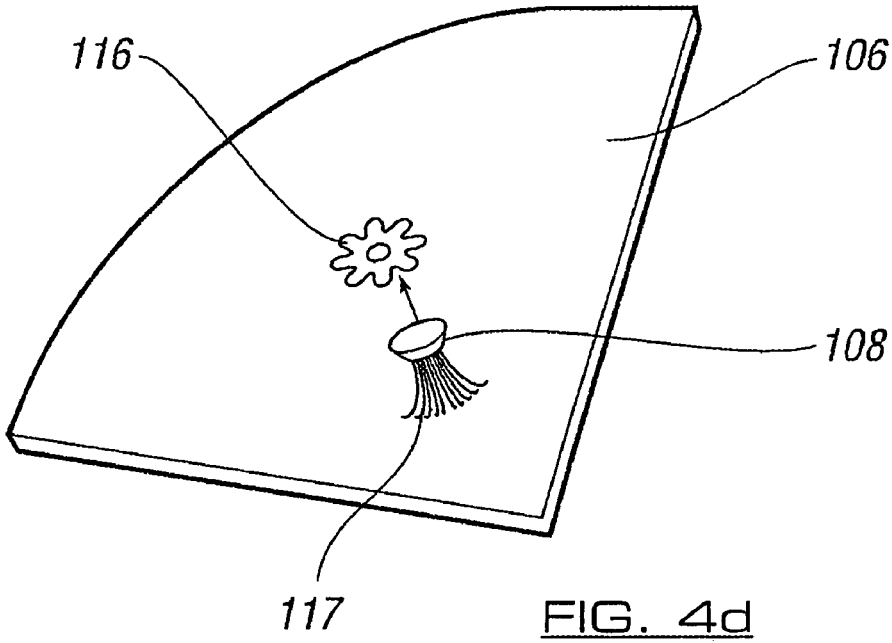
Figure 4E:
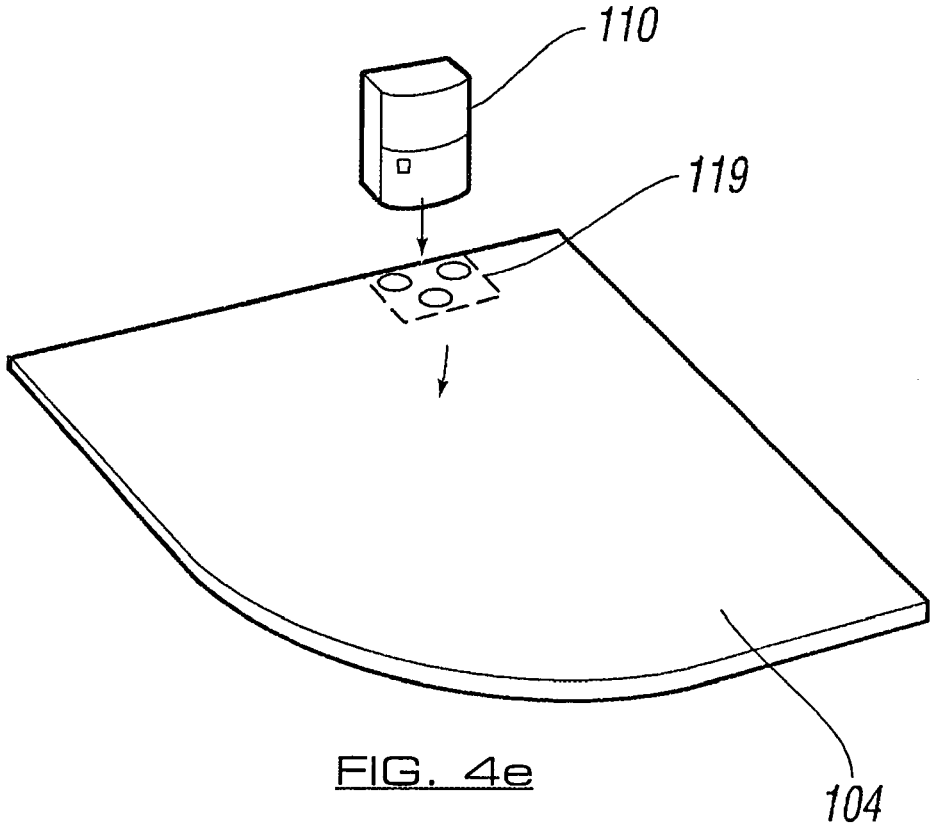
Figure 4F:
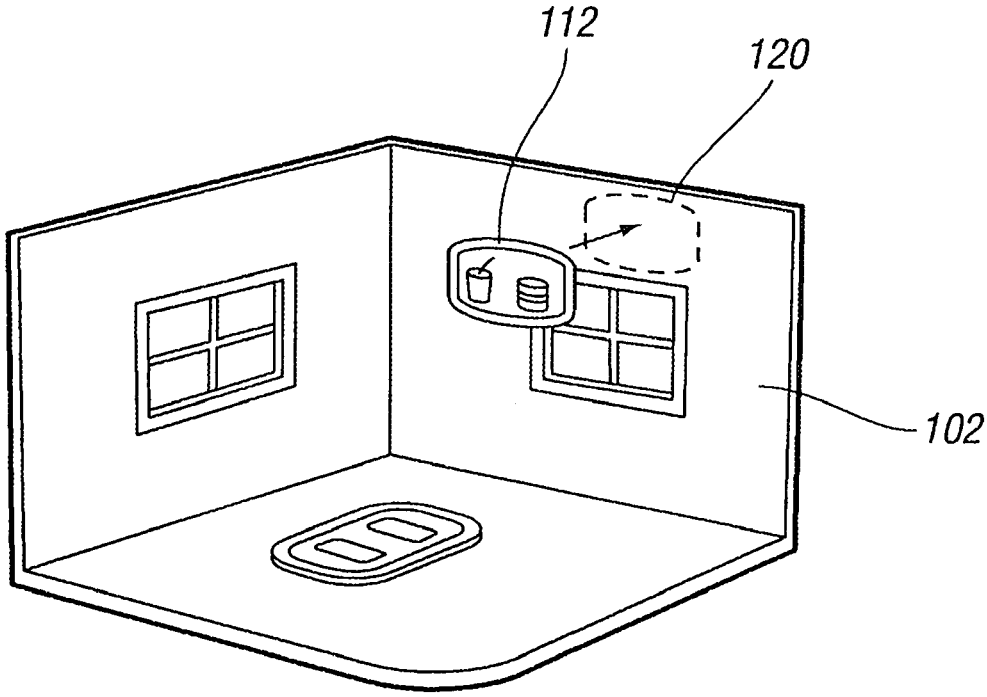
Figure 4G:
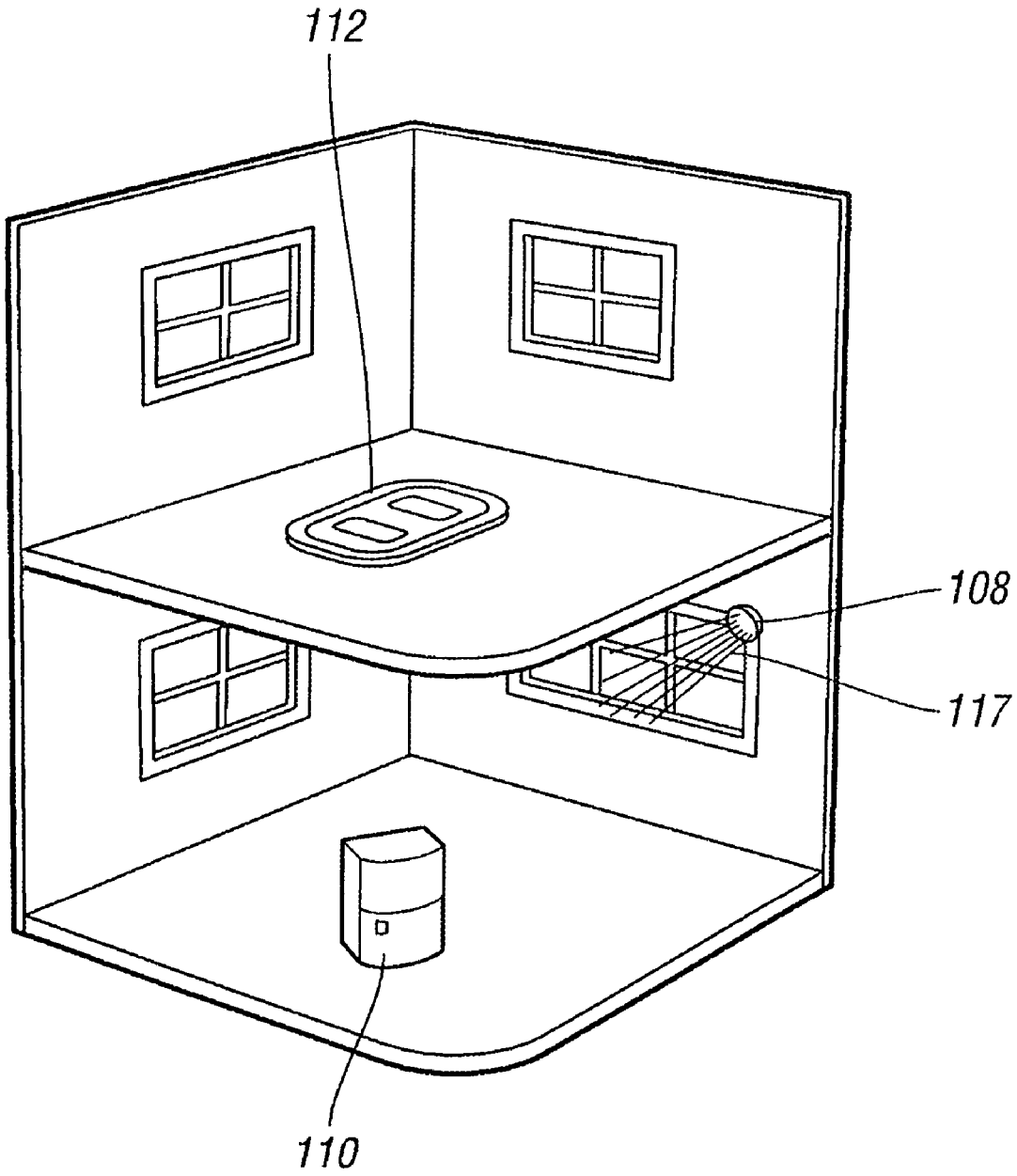

FIG. 3 illustrates the articles of FIG. 2 having been selectively positioned on the playbase and play surfaces of FIG. 1 such that the articles move from an inactive condition to an active condition in which the ceiling fan 20A rotates 30 as illustrated, the radio 20B plays a sound such as a song, the television 20C is lit up to show a picture and the table lamp 20D is lit. In each case, the article includes therein, means which can be activated by the supply of power. For example, the radio includes a sound chip which is activated by power, the ceiling fan includes a miniaturised motor which drives the rotation of the fan and the lamp includes an LED which is lit by the application of power. The electrical power is supplied when the contact means arc positioned so as to complete the electrical circuit defined by the tracks and hence allow the supply of power via the tracks through the article to activate the particular means in each of the articles.

It will therefore be appreciated that the current invention provides an additional degree of interactivity in a toy.

FIGS. 4*a–g* illustrate a practical implementation of the invention in a toy model of part of a house 100 which has walls 102, and first and second floors 104, 106 which can be slotted into position as indicated by arrow 103, and can be colour coded or otherwise identifiable to allow the floors to be located correctly.

In operation, the power is switched on to electrically conductive material (not shown) on the floors 104, 106 and there is provided in this embodiment an article in the form of a fountain 108, an article in the form of a jukebox 110, and a sign 112, each of which has a function which is operable when power is supplied thereto.

The fountain 108 is operable by placing the same on the floor pattern 114 on the floor 104 or on the flower 116 on the ceiling, or the underside of floor 106. When connected, and with the power switched on, the strands 117 light up to give the appearance of a fountain.

For the jukebox 110, the same is placed on the provided position 119 on the floor 104 wherein the jukebox is powered and a button can be depressed by the child to cause the same to play music. With regard to the sign 112, this can be caused to illuminate by placing the same in position 120 on the wall 102, which has a conductive track provided thereon.

Alternatively any or any combination of the articles 108, 110, 112 can be placed anywhere where there is provided a conductive track to allow the same to function.

The invention claimed is:

1. A toy, said toy including a playbase and/or play surface and, at least one article, said article provided for selective positioning on the playbase and/or surfaces and provided with location means to allow the said article to be retained in a selected position, said at least one article having a function which can be seletively changed between an inactive condition and an active condition and wherein at least one portion of the playbase or play surface includes two electrically conductive material portions connected to a power supply defining electrical tracks, a first track connected to a positive terminal of a power supply, a second track connected to a negative terminal of the power simply, the two tracks separated by non-conductive material and are adjacent substantially along the length and said article includes first and second electrical contacts such that the article can be placed with a first contact on said first or second track and a second contact on the other of the first or second tracks to complete an electrical circuit, said tracks supplying power to the article to change the said function to an active condition.

2. Apparatus according to claim 1 wherein the article includes a base and the contacts are located at the base of said article.

3. Apparatus according to claim 1 wherein the contacts also act as retaining means to retain or attract the article to said surface.

4. Apparatus according to claim 1 wherein the playbase or play surfaces include or are formed by a magnetically attractive material.

5. Apparatus according to claim 4 wherein the contacts on the article are magnetic.

6. Apparatus according to claim 5 wherein the contacts act to securely locate the article on the playbase or surface to allow electrical contact.

7. Apparatus according to claim 1 wherein the track or tracks are applied by the application of a conductive ink.

8. Apparatus according to claim 7 wherein the spacing between adjacent tracks matches the spacing of the electrical contacts on the article.

9. Apparatus according to claim 1 wherein the track is applied in a configuration so as to ensure that the adjacent portions of the track are spanned by the base of the article.

10. Apparatus according to claim 1 wherein the at least one function is any, or any combination of, a sound generating means, a movement generating means and/or light generating means.

11. Apparatus according to claim 1 wherein said one portion includes a boundary having a width greater than the largest size of the contacts on the article.

12. A toy model, said model depicting a play environment in which one or a series of articles can be selectively positioned and retained in said position by engagement means, and wherein said article has a function which is activated upon the supply of electrical power thereto via electrical contacts mounted on the article and said model includes at least one surface on or adjacent to which is provided two electrically conductive tracks over a defined area, said tracks separated by a non-conductive material and the two tracks are adjacent substantially along the length of the boundary, said tracks connected to a power supply such that positioning of said article on the tracks in said defined area causes power to be supplied to activate the function, and the positioning of said article is range-taking with respect to the supply of power.

13. A toy model according to claim 12 wherein the surface has indication means to indicate the position in said defined area where activation of the article function will occur.

* * * * *